US011459513B2

(12) United States Patent
Koseoglu et al.

(10) Patent No.: US 11,459,513 B2
(45) Date of Patent: Oct. 4, 2022

(54) STEAM CRACKING PROCESS INTEGRATING OXIDIZED DISULFIDE OIL ADDITIVE

(71) Applicant: SAUDI ARABIAN OIL COMPANY, Dhahran (SA)

(72) Inventors: Omer Refa Koseoglu, Dhahran (SA); Robert Peter Hodgkins, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/160,626

(22) Filed: Jan. 28, 2021

(65) Prior Publication Data

US 2022/0235278 A1 Jul. 28, 2022

(51) Int. Cl.
*C10G 9/36* (2006.01)

(52) U.S. Cl.
CPC ..... *C10G 9/36* (2013.01); *C10G 2300/1055* (2013.01); *C10G 2300/4006* (2013.01); *C10G 2300/4012* (2013.01); *C10G 2300/708* (2013.01); *C10G 2300/80* (2013.01); *C10G 2400/02* (2013.01); *C10G 2400/06* (2013.01); *C10G 2400/20* (2013.01); *C10G 2400/26* (2013.01)

(58) Field of Classification Search
CPC ..... C10G 9/36; C10G 9/16; C10G 27/00–14; C10G 75/00–04; C10G 2300/4012; C10G 2300/4006; C10G 2300/1055; C10G 2300/80; C10G 2400/20; C10G 2400/02; C10G 2400/06; C10G 2400/26
See application file for complete search history.

(56) References Cited

U.S. PATENT DOCUMENTS

| | | | | |
|---|---|---|---|---|
| 4,138,325 | A * | 2/1979 | Beuther | C10G 65/16 208/50 |
| 5,417,844 | A * | 5/1995 | Boitiaux | B01J 23/755 208/143 |
| 5,954,943 | A * | 9/1999 | Tong | C10G 9/16 208/48 R |
| 8,057,707 | B2 | 11/2011 | Srinivas et al. | |
| 9,790,175 | B2 | 10/2017 | Shown et al. | |
| 10,781,168 | B2 | 9/2020 | Koseoglu et al. | |
| 10,793,782 | B2 | 10/2020 | Koseoglu et al. | |
| 10,800,983 | B2 | 10/2020 | Al-Ghamdi et al. | |

(Continued)

FOREIGN PATENT DOCUMENTS

| | | | | |
|---|---|---|---|---|
| WO | 2005111175 | A1 | 11/2005 | |
| WO | WO-2005111175 | A1 * | 11/2005 | C10G 75/04 |

(Continued)

OTHER PUBLICATIONS

A. M. Fakhriev, et al., "Hydrocarbon pyrolysis in the presence of disulfide oil—a coke-formation inhibitor," Oct. 15, 2020 (Abstract).

(Continued)

*Primary Examiner* — Michelle Stein
(74) *Attorney, Agent, or Firm* — Leason Ellis LLP

(57) ABSTRACT

Oxidized disulfide oil (ODSO) compounds or ODSO compounds and disulfide oil (DSO) compounds are added to a steam cracker feed. During the thermal cracking, the ODSO or ODSO and DSO components in the steam cracker mixture minimize coke formation on the steam cracker coils.

17 Claims, 5 Drawing Sheets

(56) References Cited

U.S. PATENT DOCUMENTS

| | | | | |
|---|---|---|---|---|
| 2002/0029514 | A1* | 3/2002 | Lindstrom | C10G 9/16 44/640 |
| 2005/0032654 | A1* | 2/2005 | Mondal | C10L 1/2456 508/273 |
| 2015/0344785 | A1* | 12/2015 | Soultanidis | C10G 49/26 208/44 |
| 2017/0298281 | A1* | 10/2017 | Weers | C07C 7/14858 |
| 2018/0142167 | A1* | 5/2018 | Al-Ghamdi | B01D 3/009 |
| 2018/0208856 | A1* | 7/2018 | Garimella | C10G 75/04 |
| 2019/0264110 | A1 | 8/2019 | Choi et al. | |
| 2020/0181073 | A1 | 6/2020 | Koseoglu et al. | |
| 2020/0181517 | A1 | 6/2020 | Koseoglu et al. | |
| 2020/0332201 | A1 | 10/2020 | Koseoglu et al. | |

FOREIGN PATENT DOCUMENTS

| | | | | |
|---|---|---|---|---|
| WO | WO-2005113729 | A2 * | 12/2005 | C10G 9/16 |
| WO | 2007074127 | A1 | 7/2007 | |

OTHER PUBLICATIONS

E. Ziarifar, et al., "New Design and Optimization for Replacing Dimethyl Disulfide with Wasted Disulfide Oil in Olefin Furnaces," Energy & Fuels, 32:11375-11382 (2018).

Erfan Ziarifar, et al., "Using disulfide oil as code inhibitor to reduce environmental hazards in olefin heaters," Advance in Environmental Technology, 3:183-186 (2018).

International Search Report and Written Opinion in corresponding International Patent Application No. PCT/US22/14206 dated May 10, 2022. 9 pages.

* cited by examiner

STEAM CRACKING PROCESS INTEGRATING OXIDIZED DISULFIDE OIL ADDITIVE

BACKGROUND OF THE INVENTION

Field of the Invention

This disclosure is directed to blending oxidized disulfide oil compounds or a mixture of disulfide oil and oxidized disulfide oil with a steam cracker feed in order to minimize coke formation.

Description of Related Art

Steam Cracking

Steam cracking of gaseous hydrocarbons such as ethane, propane, and butanes and liquid hydrocarbons, such as light C5-C6 naphthas, is the leading technology for the production of ethylene. In the steam cracking process, the feedstocks are diluted with steam and then sent to the steam cracker furnaces. The cracking furnace is the heart of the process. Steam cracking is a complex process that is followed by cooling, compression and separation steps.

Coking is an unwanted side reaction from steam cracking. Coking is a major operational problem in the radiant section of steam cracker furnaces and transfer line exchangers. Steam dilution lowers the hydrocarbon partial pressure of the cracked compounds therefore favors the formation of primary reaction products. The steam additionally reduces the tendency of coke deposition on the furnace tubes.

Coke is not a desired product but is an inevitable side product of the pyrolysis. It is well known that surface catalyzed reactions lead to the formation of coke. In many cases, the coke formation is caused by nickel and iron on the alloy surface. Coke formation results in an increased pressure drop, impaired heat transfer and higher fuel consumption which in turn cause high production losses. The external tube skin temperature continuously rises as the formation of coke increases. This influences the process selectivity and leads to even more rapid coke formation. The coke formed can be removed by a controlled combustion with steam and air. During this coke removal process, the steam cracker furnace is in a state of non-productive downtime of. Additionally, decoking cycles lead to shorter coil life within the steam cracker furnaces.

MEROX Process

The mercaptan oxidation process, commonly referred to as the MEROX process, has long been employed for the removal of the generally foul smelling mercaptans found in many hydrocarbon streams and was introduced in the refining industry over fifty years ago. Because of regulatory requirements for the reduction of the sulfur content of fuels for environmental reasons, refineries have been, and continue to be faced with the disposal of large volumes of sulfur-containing by-products.

Disulfide oil (DSO) compounds are produced as a by-product of the MEROX process in which the mercaptans are removed from any of a variety of petroleum streams including liquefied petroleum gas, naphtha, and other hydrocarbon fractions. It is commonly referred to as a 'sweetening process' because it removes the sour or foul smelling mercaptans present in crude petroleum. The term "DSO" is used for convenience in this description and in the claims, and will be understood to include the mixture of disulfide oils produced as by-products of the mercaptan oxidation process.

As noted above, the designation "MEROX" originates from the function of the process itself, i.e., the conversion of mercaptans by oxidation. The MEROX process in all of its applications is based on the ability of an organometallic catalyst in a basic environment, such as a caustic, to accelerate the oxidation of mercaptans to disulfides at near ambient temperatures and pressures. The overall reaction can be expressed as follows:

$$RSH+\tfrac{1}{4}O_2 \rightarrow \tfrac{1}{2}RSSR+\tfrac{1}{2}H_2O \quad (1)$$

where R is a hydrocarbon chain that may be straight, branched, or cyclic, and the chains can be saturated or unsaturated. In most petroleum fractions, there will be a mixture of mercaptans so that the R can have 1, 2, 3 and up to 10 or more carbon atoms in the chain. This variable chain length is indicated by R and R' in the reaction. The reaction is then written:

$$2R'SH+2RSH+O_2 \rightarrow 2R'SSR+2H_2O \quad (2)$$

This reaction occurs spontaneously whenever any sour mercaptan-bearing distillate is exposed to atmospheric oxygen, but proceeds at a very slow rate. In addition, the catalyzed reaction (1) set forth above requires the presence of an alkali caustic solution, such as aqueous sodium hydroxide. The mercaptan oxidation proceeds at an economically practical rate at moderate refinery downstream temperatures.

The MEROX process can be conducted on both liquid streams and on combined gaseous and liquid streams. In the case of liquid streams, the mercaptans are converted directly to disulfides which remain in the product so that there is no reduction in total sulfur content of the effluent stream.

The MEROX process typically utilizes a fixed bed reactor system for liquid streams and is normally employed with charge stocks having end points above 135° C.-150° C. Mercaptans are converted to disulfides in the fixed bed reactor system over a catalyst, for example, an activated charcoal impregnated with the MEROX reagent, and wetted with caustic solution. Air is injected into the hydrocarbon feedstream ahead of the reactor and in passing through the catalyst-impregnated bed, the mercaptans in the feed are oxidized to disulfides. The disulfides are substantially insoluble in the caustic and remain in the hydrocarbon phase. Post treatment is required to remove undesirable by-products resulting from known side reactions such as the neutralization of $H_2S$, the oxidation of phenolic compounds, entrained caustic, and others.

The vapor pressures of disulfides are relatively low compared to those of mercaptans, so that their presence is much less objectionable from the standpoint of odor; however, they are not environmentally acceptable due to their sulfur content and their disposal can be problematical.

In the case of mixed gas and liquid streams, extraction is applied to both phases of the hydrocarbon streams. The degree of completeness of the mercaptan extraction depends upon the solubility of the mercaptans in the alkaline solution, which is a function of the molecular weight of the individual mercaptans, the extent of the branching of the mercaptan molecules, the concentration of the caustic soda and the temperature of the system. Thereafter, the resulting DSO compounds are separated and the caustic solution is regenerated by oxidation with air in the presence of the catalyst and reused.

Referring to the attached drawings, FIG. 1 is a simplified schematic of a generalized conventional version of a MEROX process of the prior art, i.e., MEROX unit 1010, employing liquid-liquid extraction for removing sulfur compounds in an embodiment in which a combined propane and butane hydrocarbon stream 1 containing mercaptans is treated and which includes the steps of:

introducing the hydrocarbon stream 1 with a homogeneous catalyst into an extraction vessel 10 containing a caustic solution 2, in some embodiments, the catalyst is a homogeneous cobalt-based catalyst;

passing the hydrocarbon catalyst stream in counter-current flow through the extraction section of the extraction 10 vessel in which the extraction section includes one or more liquid-liquid contacting extraction decks or trays (not shown) for the catalyzed reaction with the circulating caustic solution to convert the mercaptans to water soluble alkali metal alkane thiolate compounds;

withdrawing a hydrocarbon product stream 3 that is free or substantially free of mercaptans from the extraction vessel 10;

recovering a combined spent caustic and alkali metal alkane thiolate stream 4 from the extraction vessel 10;

subjecting the spent caustic to catalyzed wet air oxidation in a reactor 20 into which is introduced catalyst 5 and air 6 to provide the regenerated spent caustic 8 and convert the alkali metal alkane thiolate compounds to disulfide oils; and recovering a by-product stream 7 of DSO compounds and a minor proportion of other sulfides such as mono-sulfides and tri-sulfides.

The effluents of the wet air oxidation step in the MEROX process preferably comprise a minor proportion of sulfides and a major proportion of disulfide oils. As is known to those skilled in the art, the composition of this effluent stream depends on the effectiveness of the MEROX process, and sulfides are assumed to be carried-over material. A variety of catalysts have been developed for the commercial practice of the process. The efficiency of the MEROX process is also a function of the amount of $H_2S$ present in the stream. It is a common refinery practice to install a prewashing step for $H_2S$ removal.

The disulfide oil compounds produced in the MEROX process can contain various disulfides. For example, a MEROX unit designed for the recovery of propane and butane yields a disulfide oil mixture with the composition set forth in Table 1:

TABLE 1

| Disulfide Oil | W % | BP, ° C. | MW, g/g-mol | Sulfur, W % |
|---|---|---|---|---|
| Dimethyldisulfide | 15.7 | 110 | 94 | 68.1 |
| Diethyldisulfide | 33.4 | 152 | 122 | 52.5 |
| Methylethyldisulfide | 49.3 | 121 | 108 | 59.3 |
| Total (Average) | 98.4 | (127) | (109) | (57.5) |

Table 1 indicates the composition of the disulfide oil that is derived from semi-quantitative GC-MS data. No standards were measured against the components; however, the data in Table 1 is accurate as representing relative quantities. Quantitative total sulfur content was determined by energy dispersive x-ray fluorescence spectroscopy which indicated 63 W % of sulfur, and this value will be used in later calculations. The GC-MS results provide evidence of trace quantities of tri-sulfide species; however, the majority of the disulfide oil stream comprises the three components identified in Table 1.

The by-product disulfide oils produced by the MEROX unit can be processed and/or disposed of in various other refinery units' operations. For example, the DSO can be added to the fuel oil pool at the expense of a resulting higher sulfur content of the pool. The DSO can be processed in a hydrotreating/hydrocracking unit at the expense of higher hydrogen consumption. The disulfide oil also has an unpleasant foul or sour smell, which is somewhat less prevalent because of its relatively lower vapor pressure at ambient temperature; however, problems exist in the handling of this oil.

An enhanced MEROX process ("E-MEROX") is a modified MEROX process where an additional step is added. In the additional step, the DSO compounds are oxidized with an oxidant in the presence of a catalyst to produce a mixture of oxidized disulfide oil (ODSO) compounds. By-product DSO compounds from the mercaptan oxidation process can be oxidized, preferably in the presence of a catalyst, and constitute an abundant source of ODSO compounds that are sulfoxides, sulfonates, sulfinates, sulfones and their corresponding di-sulfur mixtures.

The oxidant can be a liquid peroxide selected from the group consisting of alkyl hydroperoxides, aryl hydroperoxides, dialkyl peroxides, diaryl peroxides, peresters and hydrogen peroxide. The oxidant can also be a gas, including air, oxygen, ozone and oxides of nitrogen. The catalyst is preferably a homogeneous water-soluble compound that is a transition metal containing an active species selected from the group consisting of Mo (VI), W (VI), V (V), Ti (IV), and their combination.

The ODSO compounds produced in the E-MEROX process generally comprise two phases: a water-soluble phase and water-insoluble phase. The E-MEROX process can be tuned depending on the desired ratio of water-soluble to water-insoluble compounds presented in the product ODSO mixture. Partial oxidation of DSO compounds results in a higher relative amount of water-insoluble ODSO compounds present in the ODSO product and a near or almost complete oxidation of DSO compounds results in a higher relative amount of water-soluble ODSO present in the ODSO product. Details of the ODSO compositions is discussed in the U.S. Pat. No. 10,781,168, which is incorporated herein by reference.

Table 2 includes examples of ODSO compounds produced by the oxidation of DSO by-product compounds produced in the MEROX sulfur reduction or sweetening process of hydrocarbons containing mercaptans, where R and R' are alkyl groups comprising 1-10 carbon atoms.

TABLE 2

| ODSO Name | Formula | Structure Examples |
|---|---|---|
| Dialkyl-thiosulfoxide or alkyl-alkane-sulfinothioate | (R—SO—S—R') | 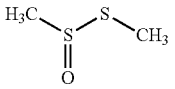 S-Methyl methanesulfinothioate |

TABLE 2-continued

| ODSO Name | Formula | Structure Examples |
|---|---|---|
| Dialkyl-thiosulfones or Alkyl-Alkane-thiosulfonate | (R—SOO—S—R') | 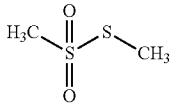 Methyl Methanethiosulfonate |
| Dialkyl-sulfonesulfoxide Or 1,2-alkyl-alkyl-disulfane 1,1,2-trioxide | (R—SOO—SO-R') | 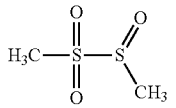 1,2-Dimethyldisulfane 1,1,2-trioxide |
| Dialkyl-disulfone Or 1,2 alkyl-alkyl-disulfane 1,1,2,2-tetraoxide | (R—SOO—SOO—R') | 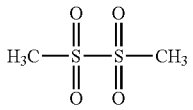 1,2-Dimethyldisulfane 1,1,2,2-tetraoxide |
| Dialkyl-disulfoxide | (R—SO—SO—R') | 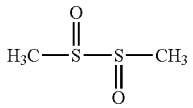 1,2-Dimethyldisulfane 1,2-dioxide |
| Alkyl-sulfoxidesulfonate | (R—SO—SOO—OH) | 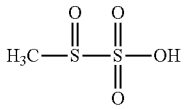 Methylsulfanesulfonic acid oxide |
| Alkyl-sulfonesulfonate | (R—SOO—SOO—OH) | 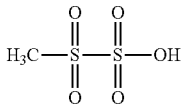 1-Hydroxy-2-methyldisulfane 1,1,2,2-tetraoxide |
| Alkyl-sulfoxidesulfinate | (R—SO—SO—OH) | 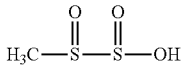 1-Hydroxy-2-methyldisulfane 1,2-dioxide |
| Alkyl-sulfonesulfinate | (R—SOO—SO—OH) | 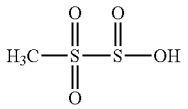 Methylsulfanesulfinic acid dioxide |

FIG. 2 is a simplified schematic of a generalized conventional version of an E-MEROX process that includes E-MEROX unit 1030. The MEROX unit 1010 unit operates similarly as in FIG. 1, with similar references numbers representing similar units/feeds.

In FIG. 2, the effluent stream 7 from the generalized MEROX unit of FIG. 1 is treated. It will be understood that the processing of the combined propane and butane stream of FIG. 1 is illustrative only and that separate streams of the products, and combined or separate streams of other mixed and longer chain products can be the subject of the process for the recovery and oxidation of DSO to produce ODSO compounds, that is the E-MEROX process.

In order to practice the E-MEROX process, it is necessary to add apparatus to recover the by-product DSO compounds from the MEROX process and provide (a) a suitable reactor 30 into which the DSO compounds are introduced in the presence of a catalyst 32 and an oxidant 34 and subjecting the DSO compounds to a catalytic oxidation step to produce the mixed stream 36 of water and ODSO compounds, and (b) a conventional separation vessel 40 to separate the by-product 44 from the ODSO compounds 42. By-product 44 generally comprises waste water when hydrogen peroxide is used as the oxidant. Alternatively, when other organic peroxides are used as the oxidant, the by-product 44 generally comprises the alcohol of the peroxide used. For example, if butyl peroxide is used as the oxidant, the by-product alcohol 44 would be butanol.

Water soluble ODSO compounds are passed to a fractionation zone (not shown) for recovery following their separation from the waste water fraction. The fractionation zone can include a distillation unit. In certain embodiments, the distillation unit can be a flash distillation unit with no theoretical plates in order to obtain distillation cuts with larger overlaps with each other or, alternatively, on other embodiments, the distillation unit can be a flash distillation unit with at least 15 theoretical plate in order to have effective separation between cuts. In certain embodiments, the distillation unit can operate at atmospheric pressure and at a temperature in the range of from 100° C. to 225° C. In other embodiments, the fractionation can be carried out continuously under vacuum conditions. In those embodiments, fractionation occurs at reduced pressures and at their respective boiling temperatures. For example, at 350 mbar and 10 mbar, the temperature ranges are from 80° C. to 194° C. and 11° C. to 98° C., respectively. Following fractionation, the waste water is sent to the waste water pool (not shown) for conventional treatment prior to its disposal. The waste water by-product fraction can contain a small amount of water insoluble ODSO compounds, e.g., in the range of from 1 ppmw to 10,000 ppmw. The waste water by-product fraction can contain a small amount of water soluble ODSO compounds, e.g., in the range of from 100 ppmw to 50,000 ppmw. In embodiments where alcohol is the by-product alcohol, the alcohol can be recovered and sold as a commodity product or added to fuels like gasoline. The alcohol by-product fraction can contain a small amount of water insoluble ODSO compounds, e.g., in the range of from 1 ppmw to 10,000 ppmw. The alcohol by-product fraction can contain a small amount of water soluble ODSO compounds, e.g., in the range of from 100 ppmw to 50,000 ppmw As described in US 2020/0181517, the ODSO compounds have been found to have utility as lubricity additives for diesel fuels that are more economical than currently available additives for that purpose, and as described in U.S. Pat. No. 10,793,782, the ODSO compounds have also been found to have utility as solvents for aromatic solvent extraction processes, both of which are incorporated herein by reference. In the event that a refiner has produced or has on hand an amount of DSO compounds that is in excess of foreseeable needs for these or other uses, the refiner may wish to dispose of the DSO compounds in order to clear a storage vessel and/or eliminate the product from inventory to reduce refinery waste.

Thus, there is a clear and long-standing need to provide an efficient and economical process for the treatment of the large volumes of DSO by-products and their derivatives to effect and modify their properties in order to facilitate and simplify their environmentally acceptable disposal, and/or to permit the utilization of the modified products within the refinery, and thereby enhance the value of this class of by-products to the refiner.

SUMMARY OF THE INVENTION

The above needs are met and other advantages are provided by the process of the present invention that economically uses oxidized disulfide oils or a blend of oxidized disulfide oils and disulfide oils, which are of relatively low value, as an additive in a steam cracking process. The additive improves steam cracking operations by minimizes coke formation in steam cracking tubes, and can also protects metallurgy of the steam cracker units. In certain embodiments an integrated MEROX, E-MEROX and steam cracker process is provided that also improves refinery efficiencies by adding an outlet for ODSO compounds and OSDO/DSO mixtures.

In an embodiment, the present disclosure is directed to a steam cracking process comprising:

introducing an oxidized disulfide oil (ODSO) stream and a steam cracker feed stream into a steam cracking complex;

mixing the ODSO stream with the steam cracker feed stream within of the steam cracker complex to produce an internal steam cracker mixture that contains ODSO components; and subjecting the internal steam cracker mixture to thermal cracking in the steam cracking complex to produce steam cracker products, wherein during the thermal cracking, the ODSO components in internal steam cracker mixture minimize coke formation on steam cracker coils.

In another embodiment, the present disclosure is directed to a steam cracking process comprising:

mixing an oxidized disulfide oil (ODSO) stream with a steam cracker feed stream to produce an enhanced steam cracker feed that contains ODSO components, introducing the enhanced steam cracker feed into a steam cracking complex; and subjecting the enhanced steam cracker feed to thermal cracking in the steam cracking complex to produce steam cracker products, wherein during the thermal cracking, the ODSO components in the enhanced steam cracker feed minimize coke formation on the steam cracker coils.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The process of the disclosure will be described in more detail below and with reference to the attached drawings in which the same number is used for the same or similar elements, and where.

DETAILED DESCRIPTION OF PREFERRED EMBODIMENTS

Figure 2:
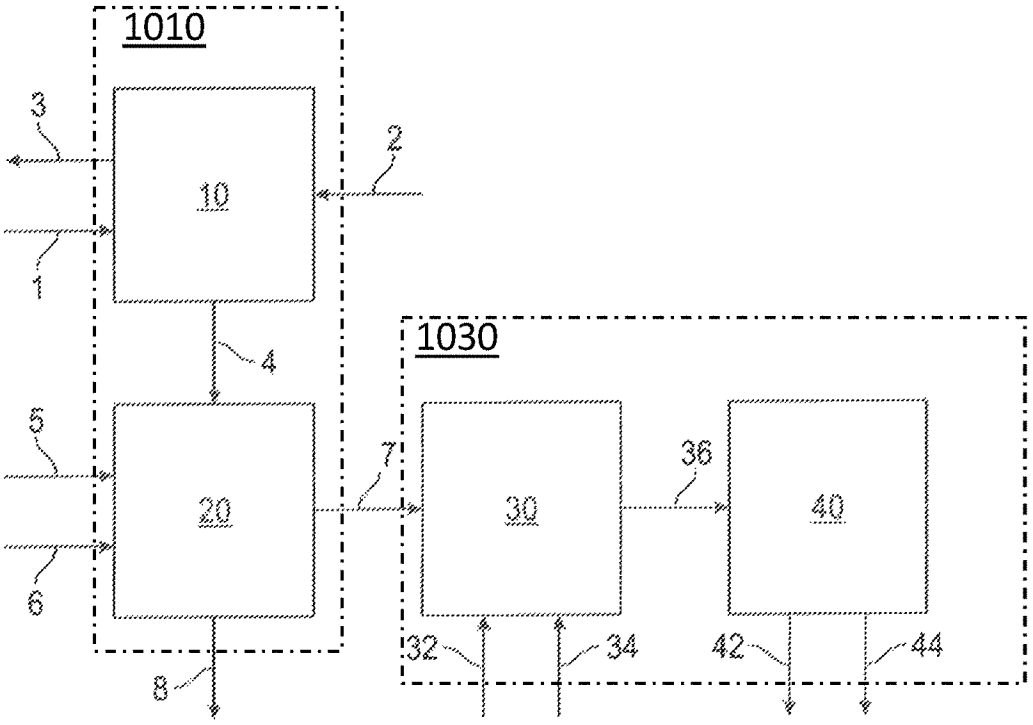
FIG. 2 (PRIOR ART)
FIG. 2 is a simplified schematic diagram of a generalized version of the enhanced mercaptan oxidation or E-MEROX process of the prior art.

Disclosed herein are processes and systems that economically use oxidized disulfide oils or a blend of oxidized disulfide oils and disulfide oils, which are of relatively low value, as an additive in a steam cracking process, whereby coke formation in the steam cracking tubes is inhibited, and the metallurgy of the steam cracker units is protected.

In the description that follows, the terms "disulfide oil", "DSO", "DSO mixture" and "DSO compounds" may be used interchangeably for convenience.

In the description that follows, the terms "oxidized disulfide oil", "derivative of disulfide oil", "ODSO", "ODSO mixture" and "ODSO compound(s)" may be used interchangeably for convenience.

In the description that follows, the terms "DSO/ODSO", "DSO/ODSO mixture" and "DSO/ODSO compound(s)" may be used interchangeably for convenience.

The phrase "a major portion" with respect to a particular stream or plural streams means at least about 50 wt % and up to 100 wt %, or the same values of another specified unit.

The phrase "a significant portion" with respect to a particular stream or plural streams means at least about 75 wt % and up to 100 wt %, or the same values of another specified unit.

The phrase "a substantial portion" means at least about 90, 95, 98 or 99 wt % and up to 100 wt %, or the same values of another specified unit.

The phrase "a minor portion" with respect to a particular stream or plural streams means from about 1, 2, 4 or 10 wt %, up to about 20, 30, 40 or 50 wt %, or the same values of another specified unit.

As used herein, all boiling point ranges relative to hydrocarbon fractions derived from crude oil via atmospheric and/or shall refer to True Boiling Point values obtained from a crude oil assay, or a commercially acceptable equivalent.

The term "naphtha" as used herein refers to hydrocarbons boiling in the range of about 20-205, 20-193, 20-190, 20-180, 20-170, 32-205, 32-193, 32-190, 32-180, 32-170, 36-205, 36-193, 36-190, 36-180 or 36-170° C.

In certain embodiments naphtha, light naphtha and/or heavy naphtha refer to such petroleum fractions obtained by crude oil distillation, or distillation of intermediate refinery processes as described herein.

The modifying term "straight run" is used herein having its well-known meaning, that is, describing fractions derived directly from the atmospheric distillation unit, optionally subjected to steam stripping, without other refinery treatment such as hydroprocessing, fluid catalytic cracking or steam cracking. An example of this is "straight run naphtha" and its acronym "SRN" which accordingly refers to "naphtha" defined above that is derived directly from the atmospheric distillation unit, optionally subjected to steam stripping, as is well known.

The term "atmospheric gas oil" and its acronym "AGO" as used herein refer to hydrocarbons boiling in the range of about 205-400, 205-380, 205-370, 205-360, 205-340, 205-320, 240-400, 240-380, 240-370, 240-360, 240-340, 240-320, 270-400, 270-380, 270-370, 270-360, 270-340 or 270-320° C.

The term "vacuum gas oil" and its acronym "VGO" as used herein refer to hydrocarbons boiling in the range of about 370-550, 370-540, 370-530, 370-510, 400-550, 400-540, 400-530, 400-510, 420-550, 420-540, 420-530 or420-510° C.

The term "fuels" refers to crude oil-derived products used as energy carriers. Fuels commonly produced by oil refineries include, but are not limited to, gasoline, jet fuel, diesel fuel, fuel oil and petroleum coke. Unlike petrochemicals, which are a collection of well-defined compounds, fuels typically are complex mixtures of different hydrocarbon compounds.

The term "aromatic hydrocarbons" or "aromatics" is very well known in the art. Accordingly, the term "aromatic hydrocarbon" relates to cyclically conjugated hydrocarbons with a stability (due to delocalization) that is significantly greater than that of a hypothetical localized structure (for example, Kekule structure). The most common method for determining aromaticity of a given hydrocarbon is the observation of diatropicity in its $^{1}H$ NMR spectrum, for example the presence of chemical shifts in the range of from 7.2 to 7.3 ppm for benzene ring protons.

The term "C # hydrocarbons" or "C #", is used herein having its well-known meaning, that is, wherein "#" is an integer value, and means hydrocarbons having that value of carbon atoms. The term "C #+ hydrocarbons" or "C #+" refers to hydrocarbons having that value or more carbon atoms. The term "C #−hydrocarbons" or "C #−" refers to hydrocarbons having that value or less carbon atoms. Similarly, ranges are also set forth, for instance, C1-C3 means a mixture comprising C1, C2 and C3.

The term "petrochemicals" or "petrochemical products" refers to chemical products derived from crude oil that are not used as fuels. Petrochemical products include olefins and aromatics that are used as a basic feedstock for producing chemicals and polymers. Typical olefinic petrochemical products include, but are not limited to, ethylene, propylene, butadiene, butylene-1, isobutylene, isoprene, cyclopentadiene and styrene. Typical aromatic petrochemical products include, but are not limited to, benzene, toluene, xylene, and ethyl benzene.

The term "olefin" is used herein having its well-known meaning, that is, unsaturated hydrocarbons containing at least one carbon-carbon double bond. In plural, the term "olefins" means a mixture comprising two or more unsaturated hydrocarbons containing at least one carbon-carbon double bond. In certain embodiments, the term "olefins" relates to a mixture comprising two or more of ethylene, propylene, butadiene, butylene-1, isobutylene, isoprene and cyclopentadiene.

The phrase "a major portion" with respect to a particular stream or plural streams means at least about 50 wt % and up to 100 wt %, or the same values of another specified unit.

The phrase "a significant portion" with respect to a particular stream or plural streams means at least about 75 wt % and up to 100 wt %, or the same values of another specified unit.

The phrase "a substantial portion" with respect to a particular stream or plural streams means at least about 90, 95, 98 or 99 wt % and up to 100 wt %, or the same values of another specified unit.

The phrase "a minor portion" with respect to a particular stream or plural streams means from about 1, 2, 4 or 10 wt %, up to about 20, 30, 40 or 50 wt %, or the same values of another specified unit.

Figure 3:
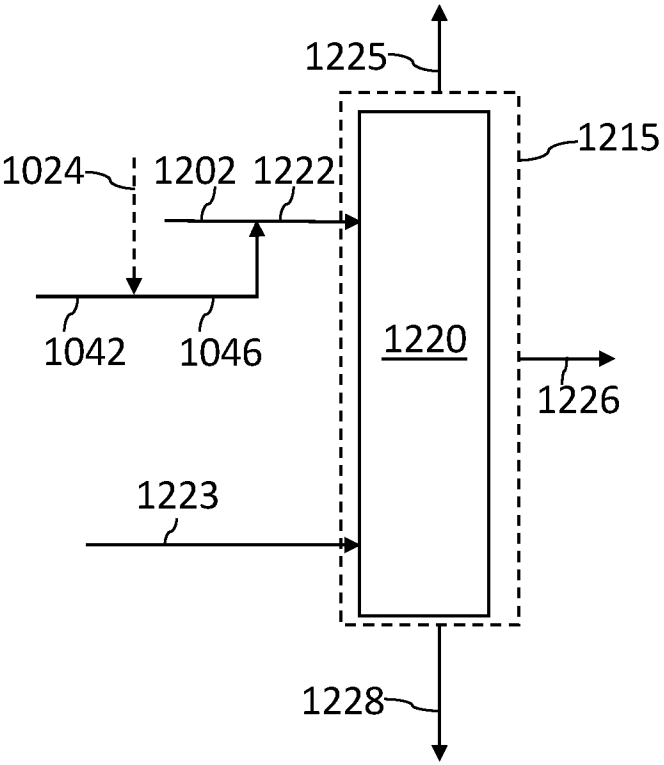
FIG. 3 is a simplified schematic diagram of an embodiment of the present disclosure.

With reference to FIG. 3, in an embodiment of the process and system an ODSO stream 1042 and a steam cracker feed 1202 are mixed and sent along with a source of steam 1223 to a steam cracking zone 1220 within a steam cracking complex 1215.

In certain embodiments, a DSO stream 1024 can be mixed with ODSO stream 1042 to produce combined DSO/ODSO stream 1046 that is then mixed with steam cracker feed 1202. In certain embodiments, the mixing can be carried out by mixing techniques known in the art such as with a separate mixing vessel equipment with a stirrer, an injector and/or an in-line mixer (not shown).

The ratio of ODSO to DSO in stream 1046 can be in the range of from 100:0 to 0.001:99.999. In certain embodiments, a substantial portion of the DSO/ODSO stream 1046 comprises ODSO compounds and a minor portion of the DSO/ODSO stream 1046 comprises DSO compounds, for example, the ratio of ODSO to DSO in stream 1046 can be in the range of from 100:0 to 99:1 or 100:0 to 95:5, or 100:0 to 90:10 V %. In certain embodiments, a significant portion of the DSO/ODSO stream 1046 comprises ODSO compounds and a minor portion of the DSO/ODSO stream 1046 comprises DSO compounds, for example, the ratio of ODSO to DSO in stream 1046 can be in the range of from 100:0 to 80:20 or 100:0 to 75:25 V %. In certain embodiments, a major portion of the DSO/ODSO stream 1046 comprises ODSO compounds and a minor portion of the DSO/ODSO stream 1046 comprises DSO compounds, for example, the ratio of ODSO to DSO in stream 1046 can be in the range of from 100:0 to 60:40 or 100:0 to 50:50 V %.

In certain embodiments, there is no DSO stream that is mixed with ODSO stream 1042 and therefore the ratio of ODSO to DSO in stream 1046 is 100:0 V %.

A steam cracker feed 1202 is mixed with ODSO stream 1042 (or DSO/ODSO stream 1046) to form an enhanced steam cracker feed 1222 which is sent to one or more inlets of a steam cracking zone 1220 along with a source of steam 1223. In certain embodiments, ODSO stream 1042 (or DSO/ODSO stream 1046) is injected to the steam cracker feed pipe that contains steam cracker feed 1202. In certain embodiments, the turbulent flow in the pipe ensures that the streams are well mixed prior to entering tubes of the steam cracking furnace(s).

In certain embodiments, steam cracking complex 1215 includes a steam cracking zone 1220 and other additional downstream processing units that will be described in detail later.

In each embodiment, the steam cracking zone 1220 within the steam cracking complex 1215, which operates as high severity or low severity thermal cracking process, generally converts a steam cracker feed 1222 into steam cracker products obtained from the steam cracking complex 1215, which generally comprise a mixed gas product stream 1225 containing mixed C1-C4 paraffins and olefins, pyrolysis gasoline 1226 and pyrolysis fuel oil 1228.

Depending on the specific configuration of the steam cracking complex 1215 (described in more detail later with reference to FIG. 7) the steam cracker products 1225 generally comprise hydrogen 1232, fuel gas 1234, ethylene 1236, propane 1246, propylene 1248, 1,3-butadiene product 1252, methyl tertiary butyl ether 1262, and 1-butene product stream 1268. In some embodiments, streams of hydrogen 1232, fuel gas 1234, ethylene 1236, propane 1246, propylene 1248, 1,3-butadiene product 1252, methyl tertiary butyl ether 1262, and 1-butene product stream 1268 are represented by a mixed product stream 1225.

The ODSO components or the combination of the DSO/ODSO components in the enhanced steam cracker feed 1222 aid in minimizing or inhibiting coke formation on the cracker coils and also protect the metallurgy of the steam cracker.

Examples of steam cracker feed 1202 include one or more of light hydrocarbons such as ethane, propane, butanes; light naphtha paraffinic hydrocarbons containing 5-6 carbons atoms; heavy naphtha hydrocarbons containing paraffins; naphthenes; aromatics with carbons number in the range of 7 to 12; mid distillate hydrocarbons containing paraffins; naphthenes and aromatics with boiling points in the range of 180 to 370° C., and straight run or hydrotreated vacuum gas oil with boiling points in the range of 370 to 565° C. In one or more specific embodiments, the steam cracker feed 1202 may comprise diesel fuel and more specifically ultra-low sulfur diesel fuel having less than 10 parts per million (ppm) sulfur in selected embodiments.

In some embodiments, preferred steam cracker feeds include one or more of low-sulfur containing feeds such as light hydrocarbons such as ethane, propane, butanes; light naphtha paraffinic hydrocarbons containing 5-6 carbons atoms.

In some embodiments, DSO can be added to the convection section of the steam cracker and ODSO can be added to the pyrolysis section.

Figure 4:
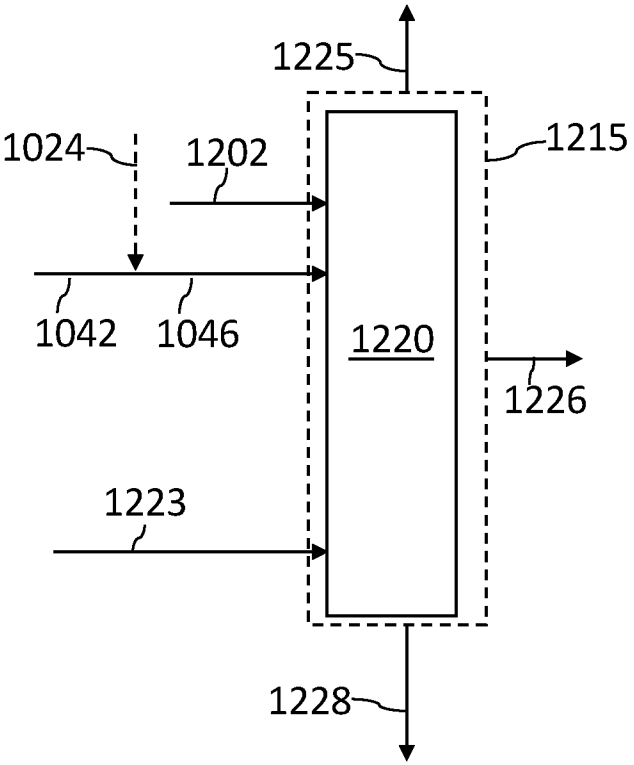
FIG. 4 is a simplified schematic diagram of an embodiment of the present disclosure.

With reference to FIG. 4, another embodiment of the process and system an ODSO stream 1042, a steam cracker feed 1202 and a source of steam 1223 are sent to a steam cracking zone 1220 within a steam cracking complex 1215.

The embodiment shown in FIG. 4 operates similarly to the embodiment shown in FIG. 3, with similar references numbers representing similar units/feeds. In certain embodiments, it may be preferable to send the ODSO compounds and steam cracker feed to the steam cracker via separate inlets. For example, depending on the exact composition and quantity of ODSO compounds present in ODSO stream 1042 (or DSO/ODSO stream 1046), the ODSO compounds may be partially or wholly immiscible with the steam cracker feed 1202. For example, ODSO compounds that have 2 oxygen atoms are oil-soluble and will be miscible with the steam cracker feed. On the other hand, ODSO compounds that have 3 or more oxygen atoms are water soluble and are generally immiscible with the steam cracker feed. In some embodiments, ppm-levels of ODSO compounds having 3 or more oxygen atoms may be miscible with the steam cracker feed.

A steam cracker feed 1202 and ODSO stream 1042 (or DSO/ODSO stream 1046) are sent via separate inlets of a steam cracking zone 1220 of a steam cracking complex 1215, along with a source of steam 1223. In this embodiment, the steam cracker feed 1202 and ODSO stream 1042 (or DSO/ODSO stream 1046) are internally mixed within the steam cracking zone 1220 prior to thermal cracking.

All or portion of a DSO stream 1024 can be mixed with ODSO stream 1042 to produce combined DSO/ODSO stream 1046, in a similar manner as that described with reference to FIG. 3, that is then sent to one or more inlets of the steam cracking zone 1220.

The ODSO components and/or the combination of the DSO/ODSO components present in the steam cracking zone 1220 aid in minimizing or inhibiting coke formation on the cracker coils and also protect the metallurgy of the steam cracker.

In certain embodiments, the amount of ODSO stream 1042 or combined DSO/ODSO stream 1046 that can be added to steam cracker feed 1202 to can be in the range of from 10-1000 ppmw, 10-500 ppmw, 10-300 ppmw, or 10-100 ppmw. The amount of ODSO or ODSO/DSO compounds added to the steam cracker feed does not depend on whether the ODSO compounds are added to the steam cracker feed prior to their introduction to the steam cracker or the ODSO compounds are added directly into the steam cracker.

As described with reference to FIGS. 3 and 4, ODSO compounds are used to reduce coke formation in the steam cracker. In certain embodiments, there can be direct integration with an E-MEROX unit, direct integration with a MEROX unit, or direct integration with an E-MEROX unit and a MEROX unit.

Embodiments of the process of the present disclosure for treating by-product oxidized disulfide oils in an integrated process that include both a MEROX and E-MEROX unit will be described with reference to FIGS. 5 and 6. Embodiments where one of an E-MEROX or MEROX unit are integrated are not shown but can also be carried out. For example, an ODSO stream can be imported and combined with a DSO stream from an integrated MEROX unit; alternatively, a DSO stream can be imported and combined with an ODSO stream from an integrated E-MEROX unit.

Figure 1:
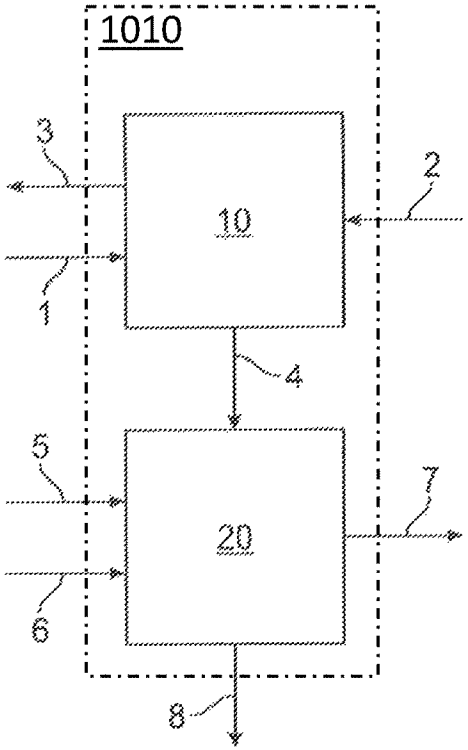
FIG. 1 (PRIOR ART)
FIG. 1 is a simplified schematic diagram of a generalized version of the mercaptan oxidation or MEROX process of the prior art for the liquid-liquid extraction of a combined propane and butane stream.
Figure 5:
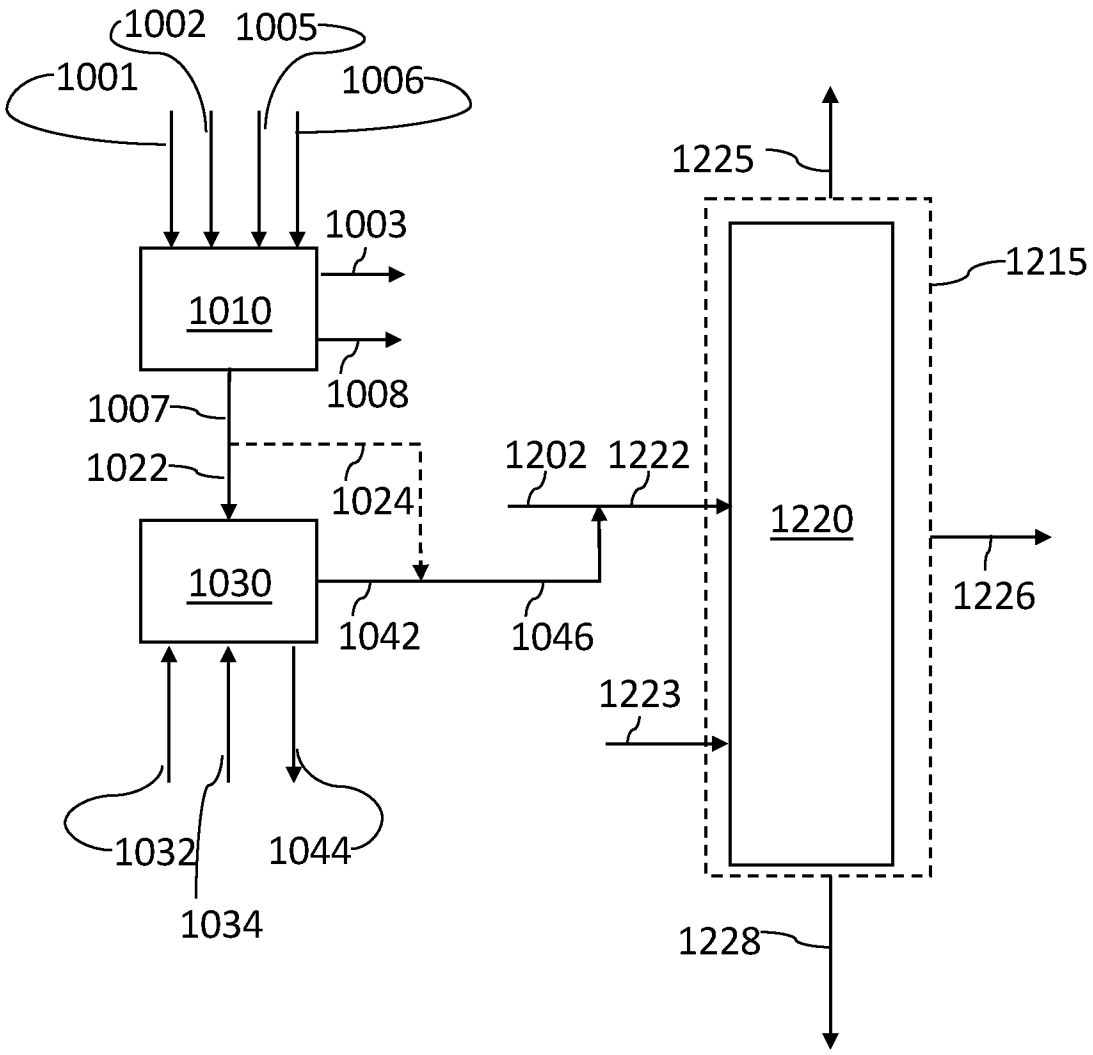
FIG. 5 is a simplified schematic diagram of an embodiment of the integrated process of the present disclosure.

With reference to FIG. 5, an embodiment of the process and system includes an MEROX unit 1010, an enhanced MEROX (E-MEROX) unit 1030, and a steam cracking complex 1215. The MEROX unit 1010 and enhanced MEROX (E-MEROX) unit 1030 operates similarly to the those in FIGS. 1-2, with similar references numbers representing similar units/feeds. All or a portion of by-product stream of DSO compounds 1007 from MEROX unit 1010 is sent to E-MEROX unit 1030 via stream 1022 for conversion into an ODSO stream 1042.

In certain embodiments, a portion of the DSO stream 1007, stream 1024, is mixed with ODSO stream 1042 to produce combined DSO/ODSO stream 1046 that is then mixed with steam cracker feed 1202.

A steam cracker feed 1202 is mixed with ODSO stream 1042 (or DSO/ODSO stream 1046) to form an enhanced steam cracker feed 1222 which is sent to steam cracking complex 1215 along with a source of steam 1223. In certain embodiments, the mixing can be carried out by mixing techniques known in the art such as with a separate mixing vessel equipment with a stirrer, an injector and/or an in-line mixer. In certain embodiments, ODSO stream 1042 (or DSO/ODSO stream 1046) is injected to the steam cracker feed pipe that contains steam cracker feed 1202. In certain embodiments, the turbulent flow in the pipe ensures that the streams are well mixed.

The ODSO components or the combination of the DSO/ODSO components in the enhanced steam cracker feed 1222 aid in minimizing or inhibiting coke formation on the cracker coils and also protect the metallurgy of the steam cracker.

Figure 6:
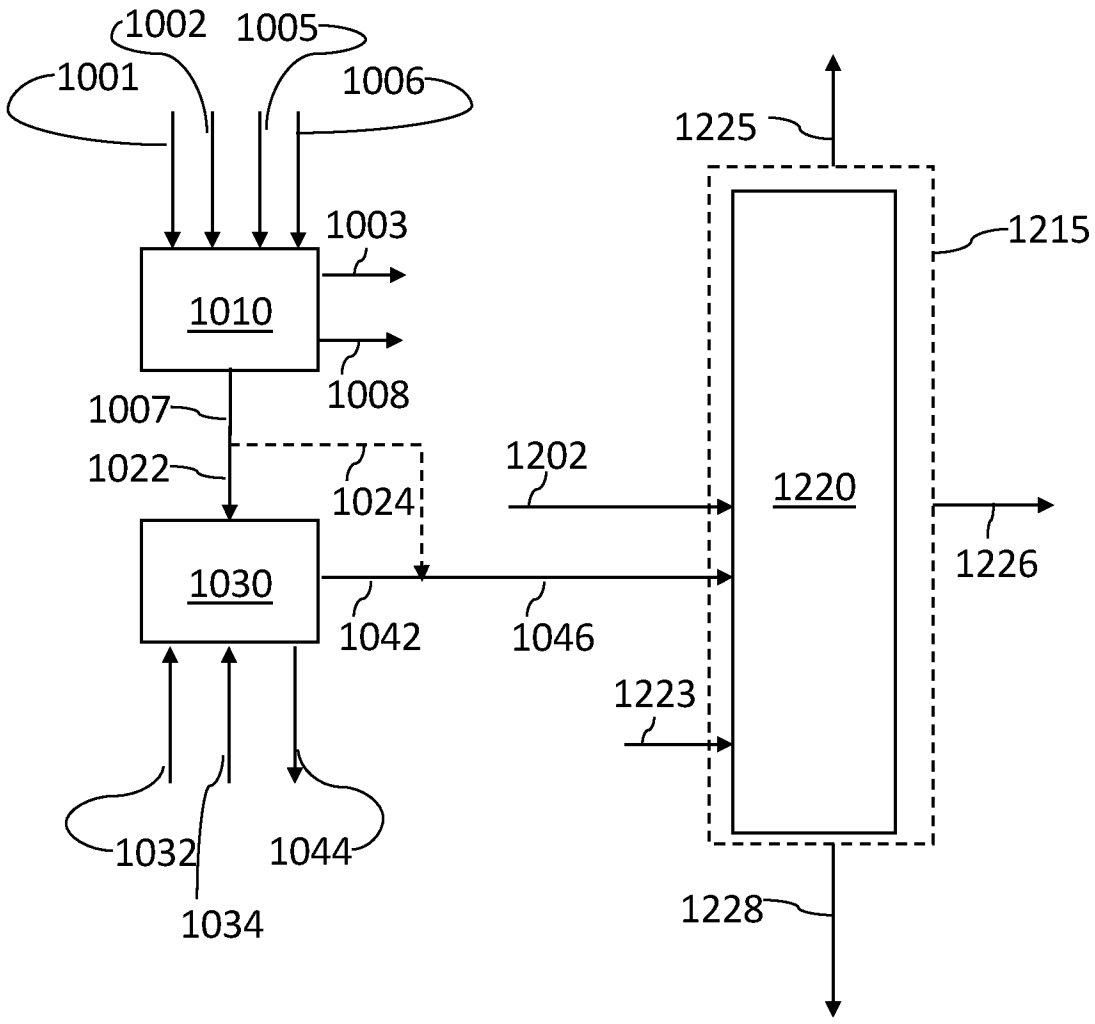
FIG. 6 is a simplified schematic diagram of an embodiment of the integrated process of the present disclosure.

With reference to FIG. 6, another embodiment of the process and system includes an MEROX unit 1010, an enhanced MEROX (E-MEROX) unit 1030, and a steam cracking complex 1215. The MEROX unit 1010 and enhanced MEROX (E-MEROX) unit 1030 operates similarly to the those in FIGS. 1-5, with similar references numbers representing similar units/feeds. In certain embodiments, it may be preferable to send the ODSO compounds and steam cracker feed to the steam cracker via separate inlets.

All or a portion of by-product stream of DSO compounds 1007 from MEROX unit 1010 is sent to E-MEROX unit 1030 via stream 1022 for conversion into an ODSO stream 1042. A steam cracker feed 1202 and ODSO stream 1042 (or DSO/ODSO stream 1046) are sent via separate inlets to steam cracking complex 1215 along with a source of steam 1223. In this embodiment, the steam cracker feed 1202 and ODSO stream 1042 (or DSO/ODSO stream 1046) are internally mixed within the steam cracking complex 1215 prior to thermal cracking.

All or portion of the DSO stream 1007, stream 1024, can be mixed with ODSO stream 1042 to produce combined DSO/ODSO stream 1046, in a similar manner as that described with reference to FIG. 5, that is then sent to steam cracking complex 1215.

The ODSO components and/or the combination of the DSO/ODSO components present in the steam cracking complex 1215 aid in minimizing or inhibiting coke formation on the cracker coils and also protect the metallurgy of the steam cracker.

In certain embodiments, the amount of ODSO stream 1042 or combined DSO/ODSO stream 1046 that can be added to steam cracker feed 1202 to can be in the range of from 10-1000 ppmw, 10-500 ppmw, 10-300 ppmw, or 10-100 ppmw. The amount of ODSO or ODSO/DSO compounds added to the steam cracker feed does not depend on whether the ODSO compounds are added to the steam cracker feed prior to their introduction to the steam cracker or the ODSO compounds are added directly into the steam cracker.

Figure 7:
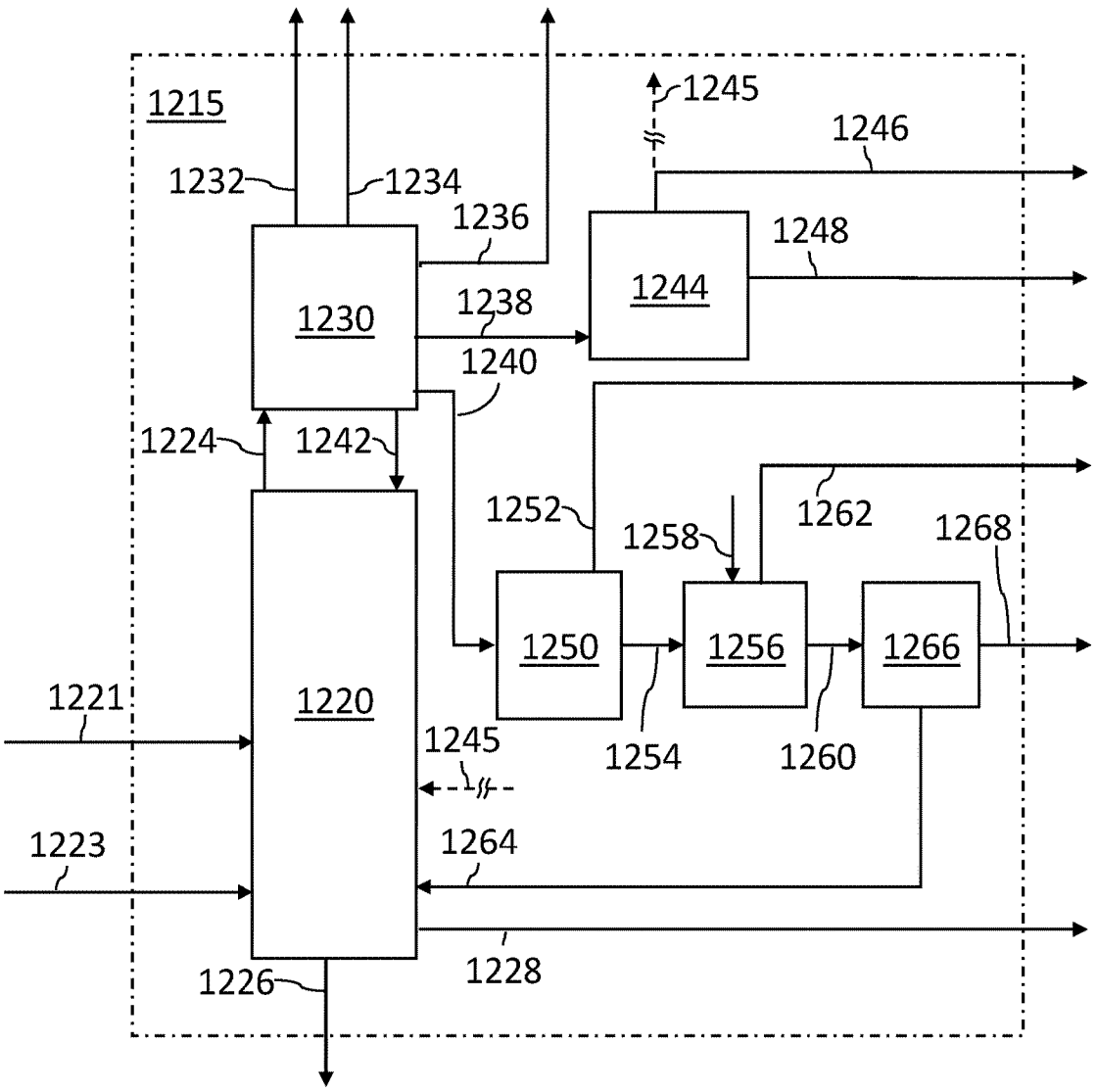
FIG. 7 is a simplified schematic diagram of a steam cracking complex of an embodiment of the integrated process of the present disclosure.

With reference to FIG. 7, as stated earlier, in some embodiments, steam cracking complex 1215 includes a steam cracking zone 1220 and other additional downstream processing units and produces at least pyrolysis gasoline 1226 and pyrolysis fuel oil 1228 as well as hydrogen 1232, fuel gas 1234, ethylene 1236, propane 1246, propylene 1248, 1,3-butadiene product 1252, methyl tertiary butyl ether 1262, and 1-butene product stream 1268 as shown in FIG. 7.

FIG. 7 includes a steam cracker feed 1221, which is either the enhanced steam cracker feed 1222 of FIGS. 3 and 5 or represents steam cracker feed 1202 and ODSO stream 1042 (or DSO/ODSO stream 1046) that are sent via separate inlets to the cracker of FIGS. 4 and 6. Steam cracker feed 1221 and a source of steam 1223 are charged to steam cracking zone 1220, which operates as high severity or low severity thermal cracking process, generally converts a steam cracker feed 1221 into primarily into a mixed product stream 1224 containing mixed C1-C4 paraffins and olefins with pyrolysis gasoline 1226 and pyrolysis fuel oil 1228 being co-produced.

In operation of the steam cracking zone 1220, effluent from the cracking furnaces is quenched (not shown), for instance, using transfer line exchangers, and passed to a quench tower. The light products, quenched cracked gas stream are routed to the olefins recovery zone 1230. Heavier products are separated in a hot distillation section. A raw pyrolysis fuel oil stream 1228 is recovered in the quench system. Pyrolysis gasoline 1226 is separated at a primary fractionator tower (not shown) before the quench tower.

In operation of one embodiment of the steam cracking zone 1220, the feedstock is preheated in a convection section. The preheated feed is fed to tubular reactors mounted in the radiant or pyrolysis sections of the cracking furnaces. The hydrocarbons undergo free-radical pyrolysis reactions to form light olefins ethylene and propylene, and other by-products. In certain embodiments, dedicated cracking furnaces are provided with cracking tube geometries optimized for each of the main feedstock types, including ethane, propane, and butanes/naphtha. Less valuable hydrocarbons, such as ethane, propane, C4 raffinate, and aromatics raffinate, produced within the integrated system and process, are recycled to extinction in the steam cracking zone 1220.

In certain embodiments, cracked gas from the furnaces is cooled in transfer line exchangers (quench coolers), for example, producing 1,800 psig steam suitable as dilution steam. Quenched cracked gas enters a primary fractionator within the steam cracking complex 1215 for removal of pyrolysis fuel oil bottoms from lighter components. The primary fractionator enables efficient recovery of pyrolysis fuel oil. Pyrolysis fuel oil is stripped with steam in a fuel oil stripper to control product vapor pressure and cooled. In addition, secondary quench can be carried out by direct injection of pyrolysis fuel oil as quench oil into liquid furnace effluents. The stripped and cooled pyrolysis fuel oil can be sent to a fuel oil pool or product storage. The primary fractionator overhead is sent to a quench water tower; condensed dilution steam for process water treating, and raw pyrolysis gasoline, are recovered. Quench water tower overhead is sent to the olefins recovery zone 1230, particularly the first compression stage. Raw pyrolysis gasoline is sent to a gasoline stabilizer to remove any light ends and to control vapor pressure in downstream pyrolysis gasoline processing. A closed-loop dilution steam/process water system is enabled, in which dilution steam is generated using heat recovery from the primary fractionator quench pumparound loops. The primary fractionator enables efficient recovery of pyrolysis fuel oil due to energy integration and pyrolysis fuel oil content in the light fraction stream.

The mixed product stream 1224 effluent from the steam cracking zone 1220 is routed to the olefins recovery zone 1230. For instance, light products from the quenching step, C4-, $H_2$ and $H_2S$, are contained in the mixed product stream that is routed to the olefins recovery zone 1230. Products include: hydrogen 1232 that is used for recycle and/or passed to users; fuel gas 1234 that can be passed to a fuel gas system; ethane 1242 that is recycled to the steam cracking zone 1220; ethylene 1236 that is recovered as product; a mixed C3 stream 1238 that is passed to a methyl acetylene/propadiene saturation and propylene recovery zone 1244; and a mixed C4 stream 1240 that is passed to a butadiene extraction zone 1250.

The olefins recovery zone 1230 operates to produce on-specification light olefin (ethylene and propylene) products from the mixed product stream. For instance, cooled gas intermediate products from the steam cracker are fed to a cracked gas compressor, caustic wash zone, and one or more separation trains for separating products by distillation. In certain embodiments two trains are provided. The distillation train includes a cold distillation section, wherein lighter products such as methane, hydrogen, ethylene, and ethane are separated in a cryogenic distillation/separation operation. The mixed C2 stream from the steam cracker contains acetylenes that are hydrogenated to produce ethylene in an acetylene selective hydrogenation unit. This system can also include ethylene, propane and/or propylene refrigeration facilities to enable cryogenic distillation.

In one embodiment, mixed product stream 1224 from the steam cracking zone 1220 is passed through three to five stages of compression. Acid gases are removed with caustic in a caustic wash tower. After an additional stage of compression and drying, light cracked gases are chilled and routed to a depropanizer. In certain embodiments light cracked gases are chilled with a cascaded two-level refrigeration system (propylene, mixed binary refrigerant) for cryogenic separation. A front-end depropanizer optimizes the chilling train and demethanizer loading. The depropanizer separates C3 and lighter cracked gases as an overhead stream, with C4s and heavier hydrocarbons as the bottoms stream. The depropanizer bottoms are routed to the debutanizer, which recovers a crude C4s stream 1240 and any trace pyrolysis gasoline.

The depropanizer overhead passes through a series of acetylene conversion reactors, and is then fed to the demethanizer chilling train, which separates a hydrogen-rich product via a hydrogen purification system, such as pressure swing adsorption. Front-end acetylene hydrogenation is implemented to optimize temperature control, minimize green oil formation and simplify ethylene product recovery by eliminating a C2 splitter pasteurization section that is otherwise typically included in product recovery. In addition, hydrogen purification via pressure swing adsorption eliminates the need for a methanation reactor that is otherwise typically included in product recovery.

The demethanizer recovers methane in the overhead for fuel gas, and C2 and heavier gases in the demethanizer bottoms are routed to the deethanizer. The deethanizer separates ethane and ethylene overhead which feeds a C2 splitter. The C2 splitter recovers ethylene product 1236, in certain embodiments polymer-grade ethylene product, in the overhead. Ethane 1242 from the C2 splitter bottoms is recycled to the steam cracking zone 1220. Deethanizer bottoms contain C3s from which propylene product 1248, in certain embodiments polymer-grade propylene product, is recovered as the overhead of a C3 splitter, with propane 1246 from the C3 splitter bottoms recycled to the steam cracking zone 1220.

A methyl acetylene/propadiene (MAPD) saturation and propylene recovery zone 1244 is provided for selective hydrogenation to convert methyl acetylene/propadiene, and to recover propylene from a mixed C3 stream 1238 from the olefins recovery zone 1230. The mixed C3 1238 from the olefins recovery zone 1230 contains a sizeable quantity of propadiene and propylene. The methyl acetylene/propadiene saturation and propylene recovery zone 1244 enables production of propylene 1248, which can be polymer-grade propylene in certain embodiments.

The methyl acetylene/propadiene saturation and propylene recovery zone 1244 receives hydrogen and mixed C3 1238 from the olefins recovery zone 1230. Products from the methyl acetylene/propadiene saturation and propylene recovery zone 1244 are propylene 1248 which is recovered, and the recycle C3 stream 1246 that can be routed to the steam cracking zone 1220. In certain embodiments, hydrogen used to saturate methyl acetylene and propadiene is derived from hydrogen 1232 obtained from the olefins recovery zone 1230.

A stream 1240 containing a mixture of C4s, known as crude C4s, from the olefins recovery zone 1230, is routed to a butadiene extraction zone 1250 to recover a high purity 1,3-butadiene product 1252 from the mixed crude C4s. In certain embodiments (not shown), a step of hydrogenation of the mixed C4 before the butadiene extraction zone 1250 can be integrated to remove acetylenic compounds, for instance, with a suitable catalytic hydrogenation process using a fixed bed reactor. 1,3-butadiene 1252 is recovered from the hydrogenated mixed C4 stream by extractive distillation using, for instance, n-methyl-pyrrolidone (NMP) or dimethylformamide (DMF) as solvent. The butadiene extraction zone 1250 also produces a raffinate stream 1254 containing butane/butene, which is passed to a methyl tertiary butyl ether zone 1256.

In one embodiment, in operation of the butadiene extraction zone 1250, the stream 1240 is preheated and vaporized into a first extractive distillation column, for instance having two sections. NMP or DMF solvent separates the 1,3-butadiene from the other C4 components contained in stream 1254. Rich solvent is flashed with vapor to a second extractive distillation column that produces a high purity 1,3-butadiene stream as an overhead product. Liquid solvent from the flash and the second distillation column bottoms are routed to a primary solvent recovery column. Bottoms liquid is circulated back to the extractor and overhead liquid is passed to a secondary solvent recovery or solvent polishing column. Vapor overhead from the recovery columns combines with recycle butadiene product into the bottom of the extractor to increase concentration of 1,3-butadiene. The 1,3-butadiene product 1252 can be water washed to remove any trace solvent. In certain embodiments, the product purity (wt %) is 97-99.8, 97.5-99.7 or 98-99.6 of 1,3-butadiene; and 94-99, 94.5-98.5 or 95-98 of the 1,3-butadiene content (wt %) of the feed is recovered. In addition to the solvent such as DMF, additive chemicals are blended with the solvent to enhance butadiene recovery. In addition, the extractive distillation column and primary solvent recovery columns are reboiled using high pressure steam (for instance, 600 psig) and circulating hot oil from another source as heat exchange fluid.

A methyl tertiary butyl ether zone 1256 is integrated to produce methyl tertiary butyl ether 1262 and a second C4 raffinate 1260 from the first C4 raffinate stream 1254. In certain embodiments C4 Raffinate 1 1254 is subjected to selective hydrogenation to selectively hydrogenate any remaining dienes and prior to reacting isobutenes with methanol to produce methyl tertiary butyl ether.

Purity specifications for recovery of a 1-butene product stream 1268 necessitate that the level of isobutylene in the second C4 raffinate 1260 be reduced. In general, the first C4 raffinate stream 1254 containing mixed butanes and butenes, and including isobutylene, is passed to the methyl tertiary butyl ether zone 1256. Methanol 1258 is also added, which reacts with isobutylene and produces methyl tertiary butyl ether 1262. For instance, methyl tertiary butyl ether product and methanol are separated in a series of fractionators, and routed to a second reaction stage. Methanol is removed with water wash and a final fractionation stage.

In operation of one embodiment of the methyl tertiary butyl ether zone 1256, the raffinate stream 1254, contains 35-45%, 37-42.5%, 38-41% or 39-40% isobutylene by weight. This component is removed from the C4 raffinate 1260 to attain requisite purity specifications, for instance, greater than or equal to 98 wt % for the 1-butene product stream 1268 from the butene-1 recovery zone 1266. Methanol 1258, in certain embodiments high purity methanol having a purity level of greater than or equal to 98 wt % from outside battery limits, and the isobutylene contained in the raffinate stream 1254 and in certain embodiments isobutylene from an optional metathesis step, react in a primary reactor. In certain embodiments the primary reactor is a fixed bed downflow dehydrogenation reactor and operates for isobutylene conversion in the range of about 70-95%, 75-95%, 85-95% or 90-95% on a weight basis. Effluent from the primary reactor is routed to a reaction column where reactions are completed. In certain embodiments, exothermic heat of the reaction column and the primary reactor can optionally be used to supplement the column reboiler along with provided steam. The reaction column bottoms stream contains methyl tertiary butyl ether, trace amounts, for instance, less than 2%, of unreacted methanol, and heavy products produced in the primary reactor and reaction column. Reaction column overhead contains unreacted methanol and non-reactive C4 raffinate. This stream is water washed to remove unreacted methanol and is passed to the 1-butene recovery zone 1266 as the C4 raffinate 1260. Recovered methanol is removed from the wash water in a methanol recovery column and recycled to the primary reactor.

The C4 raffinate stream 1260 from the methyl tertiary butyl ether zone 1256 is passed to a separation zone 1266 for butene-1 recovery. In certain embodiments, upstream of the methyl tertiary butyl ether zone 1256, or between the methyl tertiary butyl ether zone 1256 and separation zone 1266 for butene-1 recovery, a selective hydrogenation zone can also be included (not shown). For instance, in certain embodiments, raffinate from the methyl tertiary butyl ether zone 1256 is selectively hydrogenated in a selective hydrogenation unit to produce butene-1. Other co-monomers and paraffins are also co-produced. The selective hydrogenation zone operates in the presence of an effective amount of hydrogen obtained from recycle within the selective hydrogenation zone and make-up hydrogen; in certain embodiments, all or a portion of the make-up hydrogen for the selective hydrogenation zone is derived from the steam cracker hydrogen stream 1232 from the olefins recovery train 1230.

For selective recovery of a 1-butene product stream 1268, and to recover a recycle stream 1264 that is routed to the steam cracking zone 1220, one or more separation steps are used. For example, 1-butene can be recovered using two separation columns, where the first column recovers olefins from the paraffins and the second column separates 1-butene from the mixture including 2-butene, which is blended with the paraffins from the first column and recycled to the steam cracker as a recycle stream 1264.

In certain embodiments, the C4 raffinate stream 1260 from the methyl tertiary butyl ether zone 1256 is passed to a first splitter, from which isobutane, 1-butene, and n-butane are separated from heavier C4 components. Isobutane, 1-butene, and n-butane are recovered as overhead, condensed in an air cooler and sent to a second splitter. Bottoms from the first splitter, which contains primarily cis- and trans-2-butene can be added to the recycle stream 1264. In certain arrangements, the first splitter overhead enters the mid-point of the second splitter. Isobutane product can optionally be recovered in an overhead stream, 1-butene product 1268 is recovered as a sidecut, and n-butane is recovered as the bottoms stream. Bottoms from both splitters are recovered as all or a portion of recycle stream 1264.

The steam cracking zone 1220 operates under parameters effective to crack the feed into desired products including ethylene, propylene, butadiene, and mixed butenes. Pyrolysis gasoline and pyrolysis fuel oil are also recovered. In certain embodiments, the steam cracking furnace(s) are operated at conditions effective to produce an effluent having a propylene-to-ethylene weight ratio of from about 0.3-0.8, 0.3-0.6, 0.4-0.8 or 0.4-0.6.

The steam cracking zone 1220 generally comprises one or more trains of furnaces. In certain embodiments, the ODSO stream 1042 (or DSO/ODSO stream 1046) can be injected in any or all of the one or more furnaces of the steam cracker 1220.

In certain embodiments, one or more ODSO streams 1042 can be injected into steam cracker 1220. In some embodiments, one or more DSO/ODSO streams 1046 can be injected into steam cracker 1220. In some embodiments one or more ODSO streams 1042 and one or more DSO streams 1024 derived from DSO stream 1007 can be injected into steam cracker 1220.

In certain embodiments (not shown), the ODSO stream 1042 and a portion of DSO stream 1024 can be injected into one or more different furnaces of the steam cracking zone 1220. For example, in certain embodiments, ODSO stream 1042 can be injected into the first furnace of the one or more furnaces of the steam cracker 1220 and DSO stream 1024 can be injected into the second furnace of the one or more furnaces of the steam cracker 1220. These are not a limiting example and it will be apparent to those skilled in the art the various permutations of possible injection points for the one or more ODSO streams 1042, one or more DSO/ODSO streams 1046, and/or one or more DSO streams derived from DSO stream 1024.

A typical arrangement of the steam cracking zone 1220 includes reactors that can operate based on well-known steam pyrolysis methods, that is, charging the thermal cracking feed to a convection section in the presence of steam to raise the temperature of the feedstock, and passing the heated feed to the radiant or pyrolysis reactor containing furnace tubes for cracking. In the convection section, the mixture is heated to a predetermined temperature, for example, using one or more waste heat streams or other suitable heating arrangement(s).

The feed mixture is heated to a high temperature in a convection section and material with a boiling point below a predetermined temperature is vaporized. The heated mixture (in certain embodiments along with additional steam) is passed to the pyrolysis section operating at a further elevated temperature for short residence times, such as 1-2 seconds or less, effectuating pyrolysis to produce a mixed product stream.

In certain embodiments separate convection and radiant sections are used for different incoming feeds to the steam cracking zone 1220 with conditions in each optimized for the particular feed.

In certain embodiments, steam cracking in the steam cracking zone 1220 is carried out using the following conditions: a temperature (° C.) in the convection section in the range of about 400-600, 400-550, 450-600 or 500-600; a pressure (barg) in the convection section in the range of about 4.3-4.8, 4.3-4.45, 4.3-4.6, 4.45-4.8, 4.45-4.6 or 4.6-4.8; a temperature (° C.) in the pyrolysis section in the range of about 650-950, 650-900, 650-850, 700-950, 700-900, 700-850, 750-950, 750-900 or 750-850; a pressure (barg) in the pyrolysis section in the range of about 1-4, 1-2 or 1-1.4; a steam-to-hydrocarbon ratio in the convection section in the range of about 0.3:1-2:1, 0.3:1-1.5:1, 0.5:1-2:1, 0.5:1-1.5:1, 0.7:1-2:1, 0.7:1-1.5:1, 1:1-2:1 or 1:1-1.5:1; and a residence time (seconds) in the pyrolysis section in the range of about 0.05-1.2, 0.05-1, 0.1-1.2, 0.1-1, 0.2-1.2, 0.2-1, 0.5-1.2 or 0.5-1.

EXAMPLE

A hydrotreated diesel sample obtained from a commercial hydrotreating unit, the properties and composition of which are given in Table 3, was steam cracked at the bench scale steam cracking unit. The reaction unit is representative of a traditional steam cracker unit. The feedstock was doped at a concentration of 210 ppmw with a blend of disulfide oil and oxidized disulfide oil mixed at 50:50 weight ratio. The DSO in the blend is the DSO characterized in Table 1. The ODSO in the blend is the product of the oxidation of the DSO characterized in Table 1 via an E-MEROX process. The operating conditions of the reactor were a temperature of 675° C., and a reactor outlet pressure of 1 bar. The mass flow rate of hydrocarbons (HC) was fixed in order to achieve an average residence time of 8 seconds. The steam dilution factor was set to 0.6 kgH2O/kgHC·s.

TABLE 3

Composition and properties of diesel

| Property | Unit | Value |
|---|---|---|
| Density | g/cc | 0.85 |
| Sulfur | wt % | 500 |
| IBP | ° C. | 120 |
| 5 W % | ° C. | 166 |
| 10 W % | ° C. | 181 |
| 30 W % | ° C. | 232 |
| 50 W % | ° C. | 266 |
| 70 W % | ° C. | 304 |
| 90 W % | ° C. | 366 |
| 95 W % | ° C. | 401 |
| FBP | ° C. | 453 |
| n-Paraffins | wt % | 32.41 |
| i-Paraffins | wt % | 31.56 |
| Mono Aromatics | wt % | 15.02 |
| Naphtheno Mono Aromatics | wt % | 16.14 |
| Diaromatics | wt % | 3.13 |
| Naphtheno Aromatics | wt % | 1.74 |

Product yields for the example are given in Table 4. The product yields for liquid and gaseous products were normalized to 100% W.

TABLE 4

Product Yields, wt %

| Component | Yield, W % |
|---|---|
| Propylene | 13.0 |
| Ethylene | 17.5 |
| Butenes | 12.9 |
| Hydrogen | 0.5 |
| Methane | 6.5 |
| Ethane | 2.2 |
| Propane | 0.3 |
| i-butane | 0.0 |
| n-butane | 0.0 |
| Naphtha (25-221° C.) | 26.4 |
| Middle Distillate (221-343° C.) | 16.7 |
| Heavy Distillate (343° C.+) | 4.0 |
| Total | 100.0 |

Adding an otherwise waste product into a steam cracking complex not only achieves the benefits of minimizing or inhibiting coke formation on the cracker coils and protecting the metallurgy of the steam cracker, but also provides an environmentally suitable means of disposal of by-product waste and also eliminates the needs for purchasing industrial chemicals such as DMDS, which would otherwise be needed to minimizing coke formation. Additional benefits of the process described herein include eliminating or reducing the waste storage and treatment units and expenses that would otherwise be required to dispose of DSO and/or ODSO waste.

It will be understood from the above description that the process of the present disclosure provides a cost effective and environmentally acceptable means for disposing of by-product oxidized disulfide oils, and can convert what may be essentially a low value refinery material into commercially important coke inhibiting and metallurgy protecting products.

The process of the present invention has been described above and in the attached figures; process modifications and variations will be apparent to those of ordinary skill in the art from this description and the scope of protection is to be determined by the claims that follow.

The invention claimed is:

1. A steam cracking process comprising:

introducing an oxidized disulfide oil (ODSO) stream and a steam cracker feed stream into a steam cracking complex;

mixing the ODSO stream with the steam cracker feed stream within the steam cracker complex to produce an internal steam cracker mixture that contains ODSO components; and subjecting the internal steam cracker mixture to thermal cracking in the steam cracking complex to produce steam cracker products, wherein during the thermal cracking, the ODSO components in internal steam cracker mixture minimize coke formation on steam cracker coils, wherein the ODSO components are contained in a mixture and are obtained from catalytic oxidation of disulfide oil compounds from a mercaptan oxidation, the mixture comprising one or more oxidized disulfide compounds selected from the group of ODSO compounds having the general formulae R—SO—S—R', R—SOO—S—R', R—SOO—SO—R', R—SOO—SOO—R', R—SO—SO—R', R—SO—SOO—OH, R—SOO—SOO—OH, R—SO—SO—OH and R—SOO—SO—OH, wherein R and R' are alkyl groups comprising 1-10 carbon atoms.

2. The process of claim 1, wherein all or a portion of a disulfide oil (DSO) stream derived from an effluent refinery hydrocarbon stream recovered downstream of an MEROX process is combined with the ODSO stream prior to its introduction into the steam cracking complex to produce a combined ODSO/DSO stream that is mixed with the steam cracker feed, wherein the steam cracker mixture contains ODSO and DSO components, and wherein during the thermal cracking, the ODSO and DSO components in the steam cracker mixture minimize coke formation on the steam cracker coils.

3. A steam cracking process comprising:

mixing an oxidized disulfide oil (ODSO) stream with a steam cracker feed stream to produce an enhanced steam cracker feed that contains ODSO components, introducing the enhanced steam cracker feed into a steam cracking complex; and subjecting the enhanced steam cracker feed to thermal cracking in the steam cracking complex to produce steam cracker products, wherein during the thermal cracking, the ODSO components in the enhanced steam cracker feed minimize coke formation on the steam cracker coils, wherein the ODSO components are contained in a mixture and are obtained from catalytic oxidation of disulfide oil compounds from a mercaptan oxidation, the mixture comprising one or more oxidized disulfide compounds selected from the group of ODSO compounds having the general formulae R—SO—S—R', R—SOO—S—R', R—SOO—SO—R', R—SOO—SOO—R', R—SO—SO—R', R—SO—SOO—OH, R—SOO—SOO—OH, R—SO—SO—OH and R—SOO—SO—OH, wherein R and R' are alkyl groups comprising 1-10 carbon atoms.

4. The process of claim 3, wherein all or a portion of a disulfide oil (DSO) stream derived from an effluent refinery hydrocarbon stream recovered downstream of an MEROX process is combined with the ODSO stream prior to its mixing with the steam cracker feed stream to produce a combined ODSO/DSO stream that is mixed with the steam cracker feed, wherein the enhanced steam cracker feed contains ODSO and DSO components, and wherein during the thermal cracking, the ODSO and DSO components in the enhanced steam cracker feed minimize coke formation on the steam cracker coils.

5. The process of claim 2 in which the DSO stream comprises one or more disulfide compounds.

6. The process of claim 2 in which the DSO stream is combined with the ODSO stream at a ratio of ODSO to DSO components in the range of from 100:0 to 95:5.

7. The process of claim 1 in which the ratio of ODSO stream to steam cracker feed prior to thermal cracking is in the range of from 10-1000 ppmw.

8. The process of claim 2 in which the ratio of combined ODSO/DSO stream to steam cracker feed prior to thermal cracking is in the range of from 10-1000 ppmw.

9. The process of claim 1, wherein the steam cracking complex comprises a steam cracking zone, an olefins recovery zone, a methyl acetylene/propadiene saturation and propylene recovery zone, a butadiene extraction zone, a methyl tertiary butyl ether zone, and a butene-1 recovery zone, and wherein the steam cracker products comprise hydrogen, fuel gas, ethylene, propane, propylene, 1,3-butadiene product, methyl tertiary butyl ether, 1-butene product stream, pyrolysis gasoline and pyrolysis fuel oil.

10. The process of claim 9 in which the steam cracking zone operates at a temperature in the convection section in the range of about 400-600, 400-550 or 500-600° C., at a pressure in the convection section in the range of about 4.3-4.8, 4.3-4.6 or 4.6-4.8 barg, at a temperature in the pyrolysis section in the range of about 650-950, 650-900 or 650-850° C., at a pressure in the pyrolysis section in the range of about 1-4, 1-2 or 1-1.4 barg, at a steam-to-hydrocarbon ratio in the convection section in the range of about 0.3:1-2:1, 0.5:1-1.5:1 or 1:1-1.5:1, and at a residence time in the pyrolysis section in the range of about 0.05-1.2, 0.2-1.2 or 0.5-1 seconds.

11. The process of claim 1, in which the steam cracker feed is selected from the group consisting of one or more light hydrocarbons, light hydrocarbons gases containing 2-4 carbon atoms, light naphtha paraffinic hydrocarbons containing 5-6 carbons atoms, heavy naphtha hydrocarbons containing paraffins, naphthenes, aromatics with carbons number in the range of 7 to 12, mid distillate hydrocarbons containing paraffins, naphthenes or aromatics with boiling points in the range of 180 to 370° C., straight run or hydrotreated vacuum gas oil with boiling points in the range of 370 to 565° C., diesel fuel and ultra-low sulfur diesel fuel having less than 10 parts per million (ppm) sulfur.

12. The process of claim 1, wherein during the thermal cracking, the ODSO components or the ODSO and DSO components present in the steam cracking complex protect the metallurgy of the steam cracking complex.

13. The process of claim 4 in which the DSO stream comprises one or more disulfide compounds.

14. The process of claim 4 in which the DSO stream is combined with the ODSO stream at a ratio of ODSO to DSO components in the range of from 100:0 to 95:5.

15. The process of claim 3 in which the ratio of ODSO stream to steam cracker feed prior to thermal cracking is in the range of from 10-1000 ppmw.

16. The process of claim 1, wherein the ODSO components are contained in a mixture from the oxidation of DSO compounds, the mixture comprising dialkyl thiosulfoxide (R—SO—S—R'), dialkyl-thiosulfone (R—SOO—S—R'), dialkyl-sulfonesulfoxide (R—SOO—SO—R'), dialkyl-disulfone (R—SOO—SOO—R'), dialkyl-disulfoxide (R—SO—SO—R'), alkyl-sulfoxidesulfonate (R—SO—SOO—OH), alkyl-sulfonesulfonate (R—SOO—SOO—OH), alkyl-sulfoxidesulfinate (R—SO—SO—OH) and alkyl-sulfonesulfinate (R—SOO—SO—OH).

17. The process of claim 3, wherein the ODSO components are contained in a mixture from the oxidation of DSO compounds, the mixture comprising dialkyl thiosulfoxide (R—SO—S—R'), dialkyl-thiosulfone (R—SOO—S—R'), dialkyl-sulfonesulfoxide (R—SOO—SO—R'), dialkyl-disulfone (R—SOO—SOO—R'), dialkyl-disulfoxide (R—SO—SO—R'), alkyl-sulfoxidesulfonate (R—SO—SOO—OH), alkyl-sulfonesulfonate (R—SOO—SOO—OH), alkyl-sulfoxidesulfinate (R—SO—SO—OH) and alkyl-sulfonesulfinate (R—SOO—SO—OH).

* * * * *